US005889458A

United States Patent [19]

Nakamura

[11] Patent Number: 5,889,458

[45] Date of Patent: Mar. 30, 1999

[54] FUSE ASSEMBLY HAVING RADIATION REFLECTING MEANS

[75] Inventor: Goro Nakamura, Shizuoka, Japan

[73] Assignee: Yazaki Corporation, Tokyo, Japan

[21] Appl. No.: 960,435

[22] Filed: Oct. 29, 1997

[51] Int. Cl.[6] ..... H01H 85/08; H01H 85/055; H01H 85/02; H01H 85/044

[52] U.S. Cl. ..... 337/159; 337/290; 337/273; 337/282; 337/224; 337/225

[58] Field of Search ..... 337/158, 159, 337/161, 162, 166, 186, 187, 208, 227, 228, 229, 273, 290, 282, 224, 225; 361/104, 642, 646

[56] References Cited

U.S. PATENT DOCUMENTS 3,796,914 3/1974 De Caro et al. ..... 315/74
4,121,187 10/1978 Mahieu ..... 337/171
5,057,735 10/1991 Zalar et al. ..... 313/318
5,604,474 2/1997 Leach et al. ..... 337/158

FOREIGN PATENT DOCUMENTS 5-166453 7/1993 Japan ..... H01H 85/06

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A fuse assembly including a housing and a fuse element which fuses open for protection against overcurrent or short-circuit current flows. The fuse assembly also includes reflecting means such as metal polished surfaces for reflecting radiation rays generated from the fuse element back to the fuse element. The reflecting means may be formed from separate parts interposed between the fuse element and the inner wall of the housing. Alternatively, the reflecting means may be formed by applying a metal plating on a surface of an inner wall of the housing to give a mirror-like appearance to the surface.

9 Claims, 4 Drawing Sheets

FUSE ASSEMBLY HAVING RADIATION REFLECTING MEANS

BACKGROUND OF THE INVENTION

1. Field of Invention

This invention relates to a cartridge-type fuse used in an electric circuit such as those commonly found in an automobile or the like. In particular, the invention relates to a cartridge-type fuse having improved fusing time-current characteristics when an overcurrent such as a short circuit current flows through the fuse.

2. Description of Related Art

Accompanying FIG. 3 shows a conventional cartridge-type fuse assembly 1 commonly used to protect an electric circuit in an automobile or the like. As shown in FIG. 3, the fuse assembly 1 has a pair of terminals 3*a*, 3*b* connected by a fuse element 5 and resides in a housing 7 made from insulated heat-resisting resin. The fuse assembly 1 also includes a transparent cover 11 which covers the opening 9 at the upper portion of the housing 7. The housing 7 has terminal receiving chambers 4*a*, 4*b*, for receiving terminals 3*a*, 3*b*, formed inside the housing below a fuse element space 6 for containing the fuse element 5. When the terminals 3*a*, 3*b* are positioned within the terminal receiving chambers, the fuse element 5 is seated within the fuse element space 6 and straddles the terminal receiving chambers 4*a*, 4*b*. The fuse element 5 includes a fusible (current responsive) portion which fuses open when an overcurrent or short-circuit passes through it, thereby, opening the circuit connected to the fuse to protect the circuit. The condition of the fuse element including the fusible portion can be readily observed through the transparent cover 11.

Generally, in a conventional fuse as described above, the fusing time, or the time elapsing from the melting of the fusible portion of the fuse element 5 to the final opening of the circuit, is correlated to the current flow as shown in FIG. 4. Namely, the fusible portion in the conventional fuse is fused open in a very short period of time when subjected to a current flow rate in excess of 200 percent of the fuse capacity rating. However, this fusing time is relatively long when the conventional fuse is subjected to a current flow below 200 percent of the fuse capacity rating since the conventional fuse resists fusing at these lower current flows. The fusing time is also extended when an intermittent overcurrent such as a short circuit current, as opposed to a continuous current, flows through the fusible portion resulting in repeated heating and radiating of the fuse. Furthermore, in the case of an intermittent short circuit current flow, electric wires which have protective insulating coating will not radiate heat as readily as the fusible portion of the fuse element, thereby, generating smoke in the worst case.

SUMMARY OF THE INVENTION

Therefore, an object of the present invention is to overcome the foregoing problems of the prior art. In particular, the invention relates to a fuse used in a circuit for the protection against overcurrent or short-circuit current flows in which the fuse can reliably break the circuit when a short circuit occurs. Other objects of the invention are to improve the performance of the fuse by improving its accuracy and reliability.

To achieve the above objects a fuse comprises a fuse element in a fuse element space formed in a housing wherein a reflecting means for reflecting radiation rays generated from the fuse element back to the fuse element is provided in the fuse element space.

In accordance with one aspect of the present invention, the reflecting means may be a reflector having a paraboloid surface.

According to another aspect of the invention, the reflecting means may be a reflecting surface formed on an inner wall of the fuse housing containing the fuse element space.

In a fuse constructed in accordance with the present invention, heat is conserved in the fuse element by reflecting means which reflects radiation rays generated from the fuse element back to the fuse element so that the net outgoing radiation from the fuse element is reduced when an ON-OFF current flows through the fuse as in the case of an intermittent short circuit current and the short circuit current is in the OFF state. Thus, the conservation of the heat generated in the fuse element reduces the fusing time of the fusible portion when the current starts to flow again.

In a fuse having a separate reflector in the fuse element space, both radiation to the fuse housing and net radiation loss from the fuse element are substantially reduced as the reflector is interposed between the fuse element and an inner wall of the fuse housing.

In a fuse having a reflecting surface formed on an inner wall of the fuse housing containing the fuse element space, radiation rays can be reflected without adding additional parts to the fuse.

BRIEF DESCRIPTION OF THE DRAWINGS

The above objects and advantages of the present invention will become more apparent by describing in detail the preferred embodiments thereof with reference to the accompanying drawings, in which.

DETAILED DESCRIPTION OF A PREFERRED EMBODIMENT OF THE INVENTION

Figure 1:
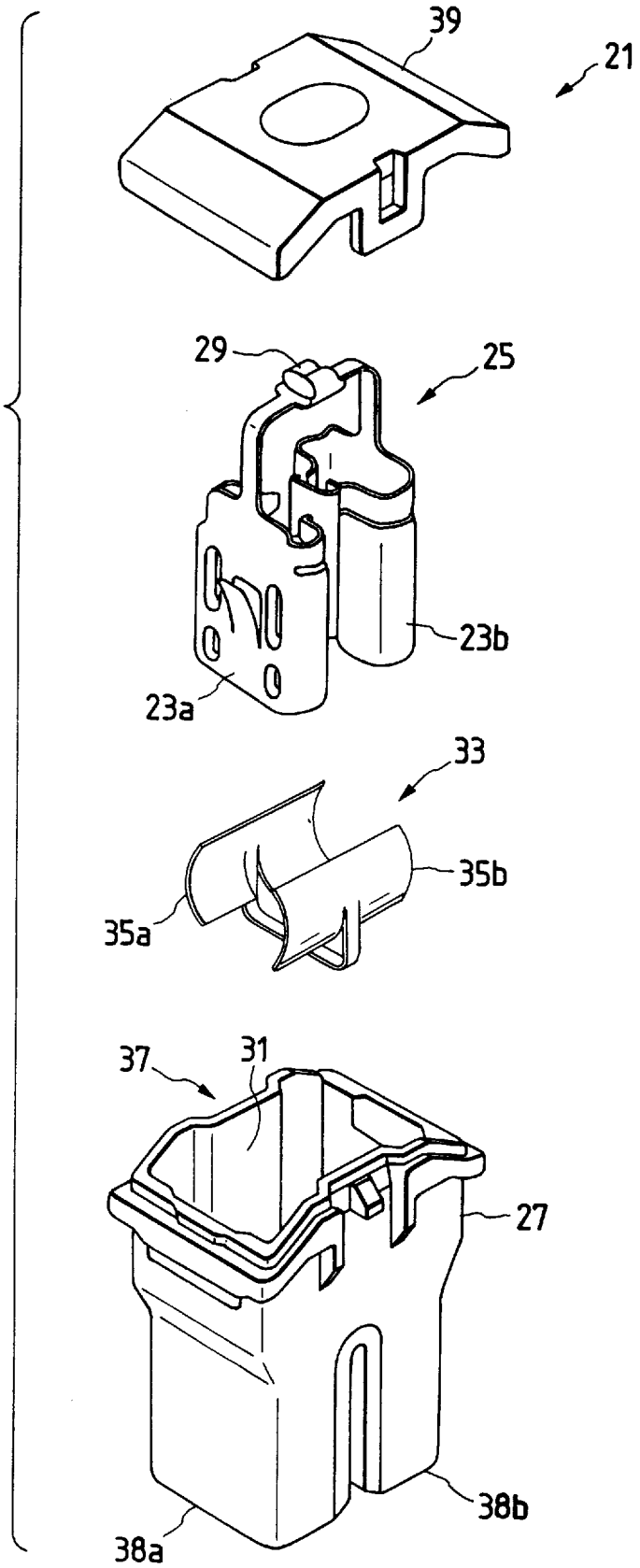
FIG. 1 is an exploded perspective view of a fuse assembly of the present invention.
Figure 2:
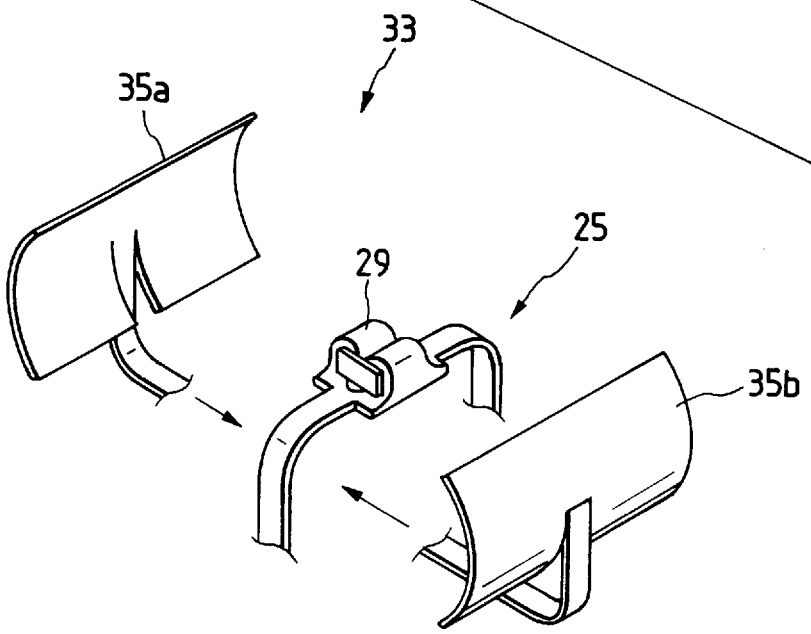
FIG. 2 is an enlarged perspective view of an important portion of the fuse assembly of FIG. 1.
Figure 3:
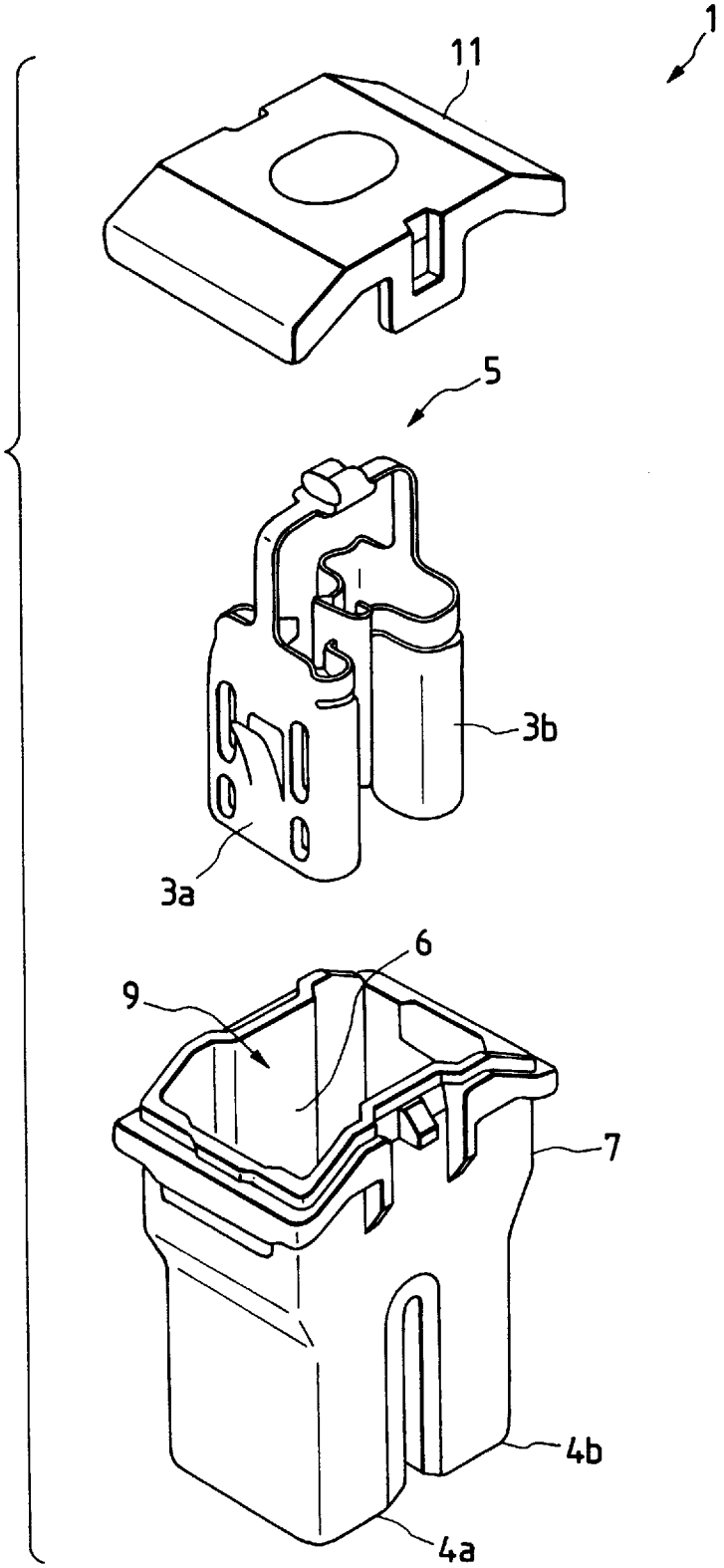
FIG. 3 is an exploded perspective view of a conventional fuse assembly.
Figure 4:
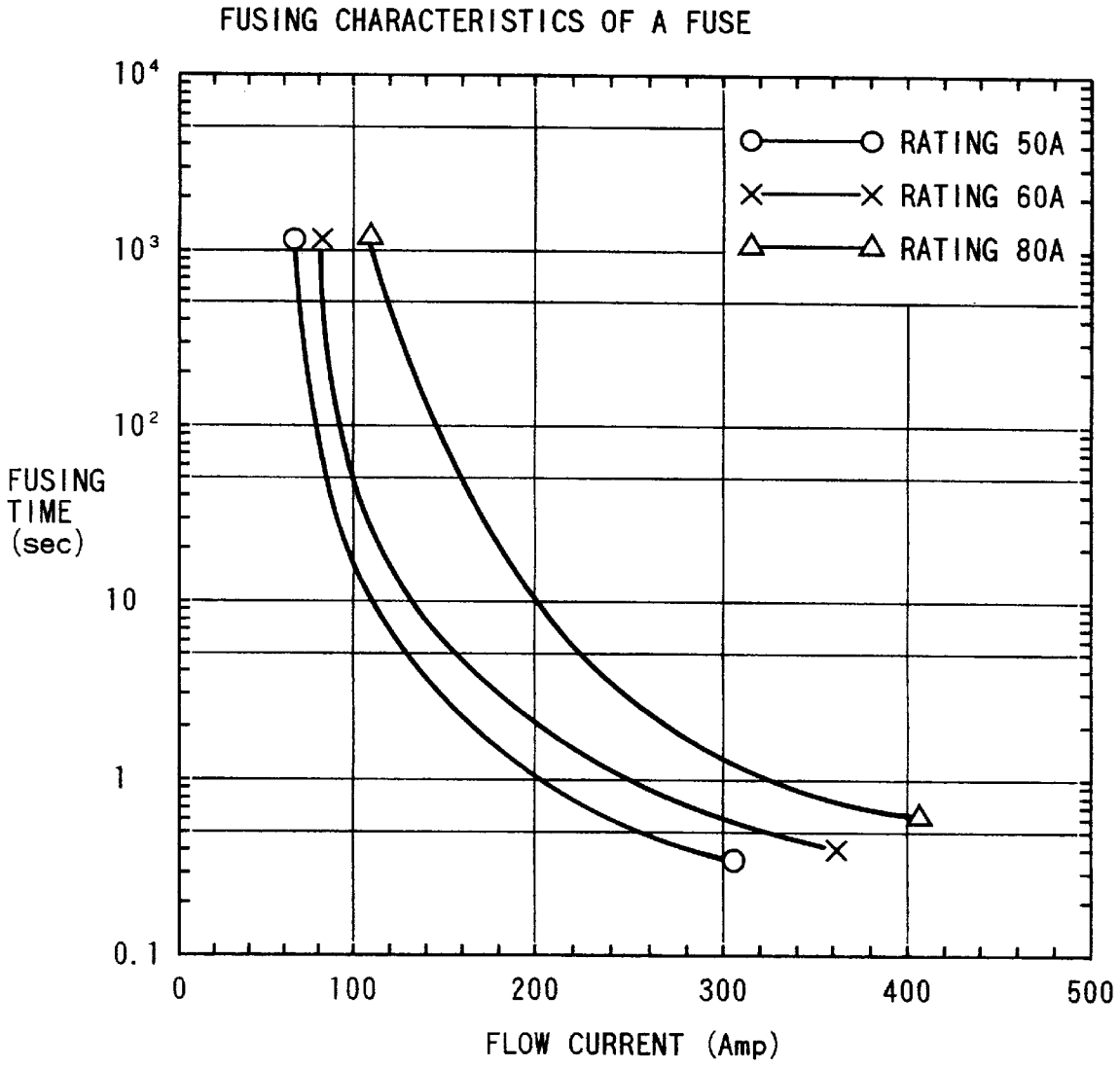
FIG. 4 is a chart showing the time-current fusing characteristics of conventional fuses.

With respect to FIGS. 1 and 2, a preferred embodiment of the fuse assembly 21 of the present invention includes a pair of terminals 23*a*, 23*b* connected by a fuse element 25 seated in a housing 27 of insulated heat-resisting resin. A fusible portion 29 in the fuse element 25, as with a conventional fuse element, is made from a low-melting alloy such as copper, tin, and the like so that it fuses open by the heat generated when an electric current over the rated fuse value flows through the fuse element, thereby, opening the circuit connected to the fuse assembly and protecting the associated electric wires, equipment, and the like.

The housing 27 has terminal receiving chambers 38*a*, 38*b* for receiving terminals 23*a*, 23*b* formed inside the housing below a fuse element space 31 for containing the fuse element 25. When the terminals 23*a*, 23*b* are positioned within the terminal receiving chambers, the fuse element 25 is seated within the fuse element space 31 and straddles the terminal receiving chambers 38*a*, 38*b*.

A reflecting means 33 is provided in the fuse element space 31 for reflecting radiation rays generated from the fuse element 25 back to the fuse element 25. In this preferred embodiment, the reflecting means 33 is formed by a pair of reflectors (e.g., half-cylindrical boards) 35*a*, 35*b*. The concave surfaces of half-cylindrical boards 35*a*, 35*b* are disposed opposite one another so that the fusible portion 29 is located at or near a focal point of the concave surfaces 35*a*, 35*b*. As a result of this arrangement, radiation rays generated from the fusible portion 29 which flow toward the half-cylindrical boards 35*a*, 35*b* are gathered and reflected back to the fusible portion 29.

An opening 37 located at the upper portion of the housing 27 containing the fuse element 25, terminals 23*a*, 23*b* and reflectors 35*a*, 35*b* is covered by a transparent cover 39 so that the condition of the fuse element 25 including the fusible portion 29 can be readily observed through the transparent cover 39.

A function of the fuse assembly 21 as constructed above is described below.

Heat energy generated from the heating of the fuse element 25 is transferred directly through the space surrounding the fuse element in the form of electromagnetic waves. That is, an object having a temperature above absolute zero degrees discharges its internal energy in the form of electromagnetic waves. Heat is transferred by rechanging the electromagnetic waves into internal energy in the object which absorbs them. This heat transfer in the form of electromagnetic waves is known as a thermal radiation. The wavelength of electromagnetic waves (radiation rays) is approximately $0.3\mu$ to $10\mu$ meters. However, most electromagnetic waves belong to the band of infrared rays having wavelengths longer than visible radiation (i.e., $0.38\mu$ to $0.76\mu$ meters). These electromagnetic waves can be ref lected off a surface such as one formed from a highly polished metal without oxidation or impurities wherein the angle of reflection is equivalent to the angle of incidence.

Based on the foregoing description, heat generated in fuse element 25 can be conserved by means of the half cylindrical boards 35*a*, 35*b* reflecting the radiation rays from the fuse element 25 back to the fuse element 25. As a result, outgoing radiation from the fuse element 25 can be reduced when an ON-OFF current flows through the fuse as in the case of an intermittent short circuit current and the short current is in the OFF state.

A result of having the radiation rays reflected back towards the fusible portion 29 of the fuse element 25 is the increase in temperature of the fusible portion 29 without biasing the potential drop of the fuse element 25 in which an intermittent short current flows.

Furthermore, the fusing of the fusible portion 29 can be accelerated by using a material such as tin (Sn) with a base material made of a copper alloy, for example, in conjunction with the heat retaining function provided by the half cylindrical boards 35*a*, 35*b*. Accordingly, the fusing temperature of the fusible portion 29 is lower than the melting point of the base material, thereby, reducing the fusing time.

An additional advantage of the preferred embodiment is that the radiation rays which would otherwise reach the housing 27 are interrupted by the interposed half cylindrical boards 35*a*, 35*b*. The temperature of the housing 27 is, therefore, prevented from rising.

Thus, in the fuse assembly 21 as described above, the half cylindrical boards 35*a*, 35*b* are disposed around the fuse element 25, and heat generated within the fuse element is conserved by reflecting the radiation rays from the fuse element 25 back to the fuse element 25 so that the outgoing radiation of the fusible portion 29 can be reduced in an intermittent short circuit current. The fusing time is thereby shortened even in an electric current in which the current flow rate is below 200 percent of the fuse rating. A fuse according to the above description is responsive to both an excess current and an intermittent ON-OFF rush current which flows in a short circuit current providing improved performance for circuit protection. The fuse of the present invention, therefore, can protect electric wires and circuits from an abnormal current in an intermittent short circuit current which, heretofore, has not been possible with general fuses in large current circuits as those used in an automobile or the like.

In a modification of the preferred embodiment, the reflecting means 33 need not be formed by half cylindrical boards as described above. Rather, any suitable shape may be used such as half spherical boards or objects having paraboloid surfaces.

In another modification, the reflecting means may be formed by applying a metal plating on the surface of an inner wall of the housing 27 (fuse element space 31) to give a mirror-like appearance to the surface. A reflecting means formed in this manner offers the advantages of the fuse assembly in accordance with the preferred embodiment while eliminating the need for providing additional parts to the fuse assembly.

As described in detail above, in the fuse assembly of the present invention, heat is retained in the fuse element by reflecting means which reflects radiation rays generated from the fuse element back to the fuse element so that the fusing time is shortened, thereby, improving the performance of the fuse assembly in an intermittent short circuit current or in a current in which the current flow rate is below 200 percent of the fuse rating. As a result, a fuse in accordance with this invention has enhanced performance characteristics and can more reliably protect electric wires and circuits from an abnormal current such as an intermittent short circuit current which was previously not possible using conventional fuses.

Moreover, in a fuse having a separated reflector in the fuse element space, the reflecting means can be manufactured relatively easy. This embodiment has the added advantage of reducing the heat transfer to the fuse housing as well as the outgoing radiation from the fuse assembly.

Furthermore, in the fuse having a reflecting surface formed on a surface of an inner wall of the fuse element space, the enhanced performance characteristics can be achieved without requiring the manufacture of additional parts.

It is contemplated that numerous modifications may be made to the fuse assembly of the present invention without departing from the spirit and scope of the invention as defined in the following claims.

What is claimed is:

1. A fuse assembly, comprising:

a housing;

a fuse element located within said housing; and means for reflecting radiation rays generated from said fuse element back to said fuse element provided within said housing, said reflecting means not being a part of said housing.

2. A fuse assembly according to claim 5, wherein said means for reflecting radiation is at least one reflector having a paraboloid surface.

3. A fuse assembly according to claim 5, wherein said means for reflecting radiation is at least one reflector having an arcuate surface.

4. A fuse assembly, comprising:

a housing having a fuse element space;

a fuse element located within said fuse element space; and means for reflecting radiation rays generated from said fuse element back to said fuse element provided within said fuse element space, said reflecting means not being a part of said housing.

5. A fuse assembly according to claim 4, further comprising a transparent cover for observing the condition of said fuse element.

6. A fuse assembly according to claim 3, wherein said means for reflecting radiation includes two half-cylindrical members.

7. A fuse assembly according to claim 6, wherein said half-cylindrical members are arranged parallel to one another on opposite sides of said fuse element.

8. A fuse assembly according to claim 6, wherein said half-cylindrical members are arranged so that their centers of curvature face the fuse element.

9. A fuse assembly according to claim 8, wherein said fuse element is at the focal point of each of said half-cylindrical members.

* * * * *

UNITED STATES PATENT AND TRADEMARK OFFICE

CERTIFICATE OF CORRECTION

PATENT NO. : 5,889,458

DATED : Mar. 30, 1999

INVENTOR(S) : Goro Nakamura

It is certified that error appears in the above-indentified patent and that said Letters Patent is hereby corrected as shown below:

Title page, insert the following:

Please insert the priority data, on the front page of the Patent as follows:

item

--[30] Oct 29, 1996 JP 8-286883--

Signed and Sealed this

Second Day of November, 1999

*Attest:*

Q. TODD DICKINSON

*Attesting Officer*

*Acting Commissioner of Patents and Trademarks*